United States Patent [19]

Klose

[11] 4,137,630

[45] Feb. 6, 1979

[54] PINCERS

[75] Inventor: Odo Klose, Wuppertal, Fed. Rep. of Germany

[73] Assignee: Werkzeug-Union GmbH-DWU, Wuppertal, Fed. Rep. of Germany

[21] Appl. No.: 841,371

[22] Filed: Oct. 12, 1977

[30] Foreign Application Priority Data

Feb. 11, 1977 [DE] Fed. Rep. of Germany ... 7704068[U]

[51] Int. Cl.[2] ..... B26B 17/04

[52] U.S. Cl. ..... 30/186

[58] Field of Search ..... 30/186, 187, 191, 193, 30/341, 175, 176, 177, 179, 257, 259

[56] References Cited

U.S. PATENT DOCUMENTS

| | | | |
|---|---|---|---|
| 1,104,768 | 7/1914 | Bernard | 30/258 |
| 1,845,434 | 2/1932 | Moskow | 30/176 |
| 2,308,684 | 1/1943 | Geddes | 30/193 |
| 2,618,058 | 11/1952 | Sundstrand | 30/176 |

*Primary Examiner*—Jimmy C. Peters

*Attorney, Agent, or Firm*—Neil F. Markva

[57] ABSTRACT

The pincers comprise two pincer legs pivotally mounted on a pivot pin about a common pivotal axis. Each leg has a handgrip portion and a head portion. The head portions extend toward each other in open arches and have cutting edges which meet in a cutting relationship. The head portions of the pincer legs are formed asymmetrically with respect to each other. A pincer head axis extends along a line connecting the center of the pivot pin with the meeting point of the cutting edges. A longitudinal medial axis extends throughout the length of the pincers between the handgrip portions. The head axis intersects the medial axis at an acute angle.

8 Claims, 7 Drawing Figures

FIG.4
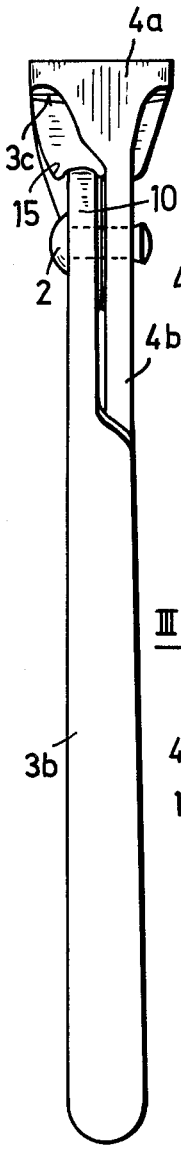
FIG.1
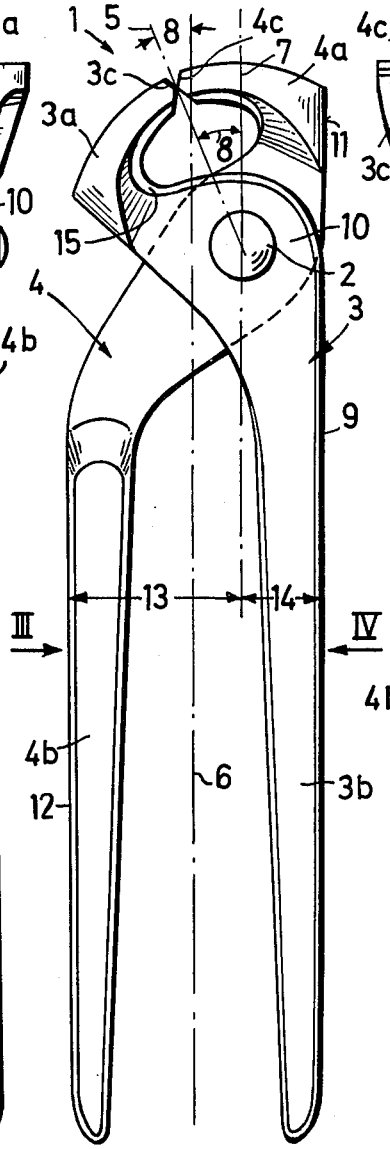
FIG.3
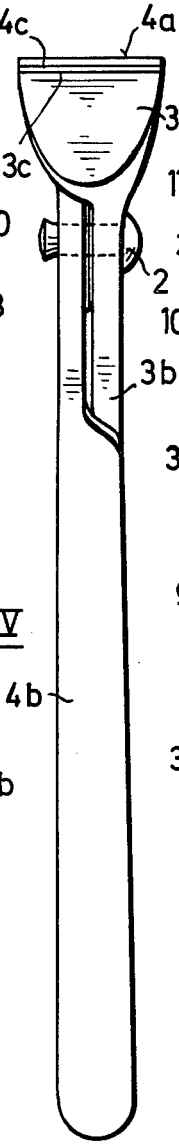
FIG.5
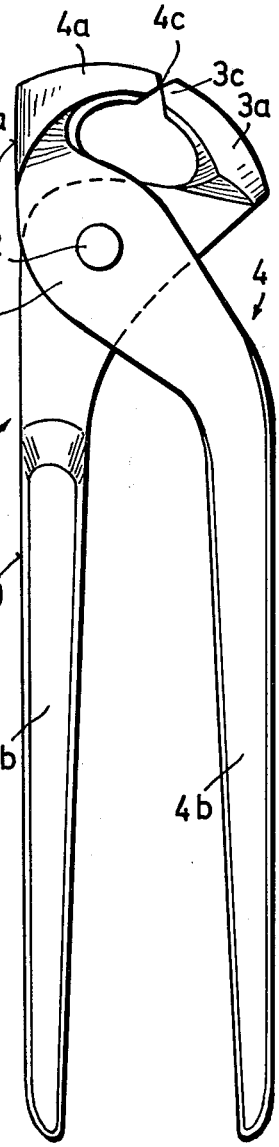
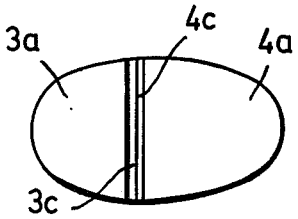
FIG.2

PINCERS

BACKGROUND OF THE INVENTION

The invention relates to improvements in pincers for industrial and household use.

As is well known, pincers have two legs which are pivotally mounted on a pin about a common axis. Each leg has a head portion and a handgrip portion. The head portions extend in mutually opposed arcs and have ends which meet to effect cutting or pinching. The handgrip portions are essentially longer than the head portions and are substantially straight. Known pincers have pincer legs consisting of head portions and handgrip portions that are mere images of each other about the longitudinal axis of symmetry. That is, they are symmetrical with respect to each other. Such a structural configuration leaves much to be desired in handling and the exertion of force during use, especially in the ergonomic sense.

So called asymmetric pincers are also known wherein the pivotal axis lies in the plane of symmetry of the handgrip parts. In these known pincers, the cutting edge is moved to almost the top of the arcuate path of one of the head portions. Such asymmetrical pincers are not universally usable. That is, practically they can only be handled from one side because one of the head portions has only a short surface. Thus, for example, no favorable rolling of the hand surface of the head portion can take place on the support while pulling nails and the like. Furthermore, due to the mean location of the pivotal axis with respect to the line of symmetry of the handgrip portions, no more leverage is obtained than in completely symmetrically formed pincers.

The primary object of the invention is to provide pincers which simplify the manipulation and holding thereof and can be used more accurately in the ergonomic sense due to the structural configuration thereof.

SUMMARY OF THE INVENTION

The pincers as defined and described herein include a pincer head axis constituting a line connecting the center of the pivot pin and the meeting point of the cutting edges. A longitudinal medial axis extends throughout the length of the pincers between the handgrip portions and is parallel thereto. The head axis intersects the longitudinal medial axis at an acute angle. The pincers include head portions having upper faces as seen in plan view that are substantially of the same length.

The asymmetrically constructed pincers of this invention provide for the head portions to be disposed to one side of the longitudinal medial axis. This construction provides a more favorable manipulation of the pincers during use, for example, in gripping and pulling out nails, pins or the like, and also in cutting through wires or the like. In the closed condition, the asymmetrically arranged pincer legs of this invention produce a smaller spacing between the handgrip portions than is achieved in the prior art pincers. By locating the pincer head to one side of the pincers, it is possible to effect a more prolonged pull and leverage in one direction. Furthermore, the asymmetric pincers of the instant invention can be used in both directions equally well. Moreover, the pincers lie more favorably to the forearm holding the pincers during use than heretofore. In general, there is an essentially improved ergonomic use of the available force in a cutting process or even in the bracing of the pincers against a fixed support.

In a further feature of the invention, in the closed position of the pincers, the pivot pin is located to one side of the longitudinal medial axis and the cutting edges of the head portions are located to the other side of the longitudinal medial axis opposite said pivot pin. Thus, the pivot pin lies relatively close to one side in the direction of one handgrip portion. Consequently, it is possible to obtain an increased application of force in the other handgrip portion during a cutting process or the like, while the head portion of the first pincer leg remains at rest thereby acting substantially more like an anvil. The cutting process is thus ergonomically essentially more efficient than with known pincers.

In another feature of the invention, one of the handgrip portions has an intermediate round portion which receives the pivot pin. This handgrip portion also includes the head portion connected thereto which extends thereover the inclined pincer head axis and extends with its outer face from the intermediate round portion without a step or shoulder formed therebetween. The outer face of the other handgrip portion advantageously extends to the intermediate portion as an extension of the outer face of the first handgrip portion. That is, the two outer face surfaces are coextensive in a straight line. This spatial construction contributes to the transfer of the transmission and application of force to the handgrip with the wide offset when the spread pincer legs are pressed together. This is ergonomically more favorable to the application of force by hand than when the force acts on the workpiece equally from both sides as in the case where pincers have a centrally located pivot pin. The application of more force to one of the handgrips is more acceptable and favorable during manipulation of the pincers. The head portion extending through the inclined pincer head axis can advantageously extend at a right angle with respect to the pivoted intermediate round portion. Also, the pincers of this invention have a wide space between the open opposed arcs of the head portions of the pincer legs despite the asymmetry.

In a further embodiment of the invention, one of the handgrip portions of the pincers has a greater bend in the region of the pivot and has a more extensive course than the other handgrip portion. Thus, the other handgrip portion can have a course openly bowed toward the first handgrip portion. Such a course of the handgrip portion improves the ability of the pincers to be picked up by hand. Furthermore, the pincer legs can still be held safely and securely at the ends of the handgrip portions to provide great leverage even when the pincers are widely opened.

A further feature of the invention provides for the additional widening of the bowed handgrip portion in the gripping zone thereof.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a front diagrammatic view of the pincers made in accordance with this invention;

FIG. 2 is a top plan view of the pincers of FIG. 1;

FIG. 3 is a side elevational view in the direction of arrow III as shown in FIG. 1;

FIG. 4 is a side elevational view in the direction of arrow IV as shown in FIG. 1;

FIG. 5 is a diagrammatic elevational view of the obverse side as shown in FIG. 1;

DESCRIPTION OF SPECIFIC EMBODIMENTS

Figure 6:
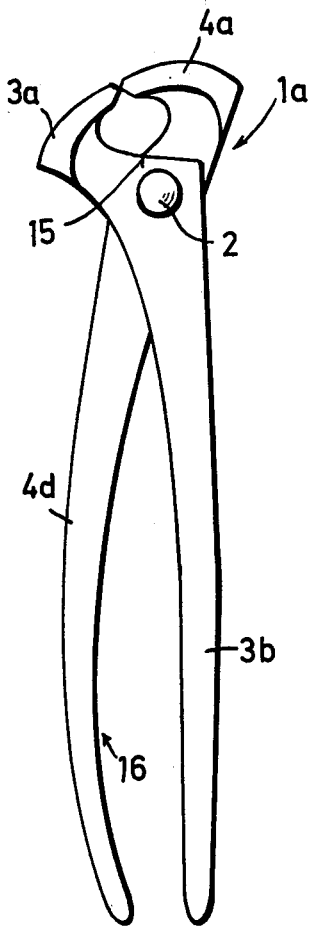
FIG. 6 is a diagrammatic elevational view of a modification of pincers made in accordance with this invention.

The pincers, generally designated 1 in FIGS. 1-5, have two legs 3 and 4 pivotally connected via pin 2. Legs 3 and 4 have head portions 3*a* and 4*a* and handgrip portions 3*b* and 4*b*. Head portions 3*a* and 4*a* extend in mutually opposed arcs and include opposed cutting edges 3*c* and 4*c*, respectively.

As shown in FIGS. 1 and 5, head portions 3*a* and 4*a* are asymmetrically formed. The pincer head axis 5 constitutes the line connecting the center of pin 2 and the meeting point of the cutting edges 3*c* and 4*c*. Head axis 5 intersects the longitudinal medial axis 6 and the parallel line 7 passing through the center of pin 2 at an acute angle 8. Thus, when the pincers are in a closed position, the pivotal axis of pin 2 is located at one side of the longitudinal medial axis 6 and the cutting edges 3*c* and 4*c* are located on the other side of medial axis 6. That is, medial axis 6 is laterally displaced with respect to pivot pin 2. Further, as is evident from the drawings, the cutting edges 3*c* and 4*c* extend transversely with respect to the plane of movement of the hand grip portions 3*b* and 4*b*. More specifically, cutting edges 3*c* and 4*c* extend perpendicularly to said plane of movement.

The head portion 3*a* of handgrip portion 3*b* extends through the inclined pincer head axis 5. The outer face 9 of handgrip portion 3*b* extends from the intermediate rounded portion 10 without the formation of a shoulder or the like so that outer face 9 is tangential with respect to the rounded intermediate portion 10. Pivot pin 2 is located in and received by the rounded portion 10.

Head portion 4*a* is connected to the wide handgrip portion 4*b* and has an outer face 11 which advantageously ends at the rounded intermediate portion 10 thereby forming an extension of the outer face 9 of the first handgrip portion 3*b*. Thus, the outer face 9 of pincer leg 3 and the outer face 11 of pincer leg 4 lie in a straight line. Consequently, pivot pin 2 lies closer to the outer faces 9 and 11 than to the outer face 12 of the handgrip portion 4*b*.

With the structural configuration of the pincers 1, the leverage or lever arm 13 for the handgrip portion 4*b* is essentially greater than the leverage or lever arm 14 for the handgrip portion 3*b*. Consequently, application of the pincers to a support to withdraw a pin or the like, or in cutting off a wire or the like, is effected efficiently. Moreover, an advantageous specific embodiment of the head portion 3*a* has the connecting portion 15 going off at a right angle from the rounded intermediate portion 10. Thus, a sufficiently large opening is formed between head portions 3*a* and 4*a* to accommodate the requisite portion of the workpiece being cut or withdrawn.

Pincers made in accordance with this invention provide an exceptionally favorable grip in use. The spread of the handgrip portions 3*b* and 4*b* provide a usable reach that is greater than in similar symmetrical pincers. The power ratio for pressing the handgrip portions toward each other and therefore the head portions toward each other is advantageous. This structure of the pincers facilitates the relation thereof and the work to be carried out by the pincers is safer and more reliable than with known prior art pincers.

Another feature of the invention is directed to the relative thicknesses of the upper faces of head portions 3*a* and 4*a* as seen in the plan view of FIG. 2. It has been found advantageous if the thickness of the upper faces seen in plan view becomes smaller relatively quickly in the direction of cutting edges 3*c* and 4*c* as shown. In the specific embodiment as shown, the face of head portions 3*a* and 4*a* is semielliptical. Thus, upper faces of head portions 3*a* and 4*a* as shown developed in a plane have the same size. That is, the upper faces of head portions 3*a* and 4*a* are substantially the same length.

The elliptical form of the two faces of head portions 3*a* and 4*a* enables a closer application of pincers 1 in corners restricted by projections, walls or the like. When gripping nails or the like, one can reach deeper into the corner. Furthermore, there is a considerable lateral projection of the head portions 3*a* and 4*a* beyond the width of handgrip portions 3*b* and 4*b* as shown in FIGS. 3 and 4. Thus, in withdrawing long nails or the like, contact of the latter with projecting parts of the pivot pin 2 is avoided. Nails do not have to be withdrawn laterally by these pincers. Thus, pincers 1 are universally usable.

Figure 7:
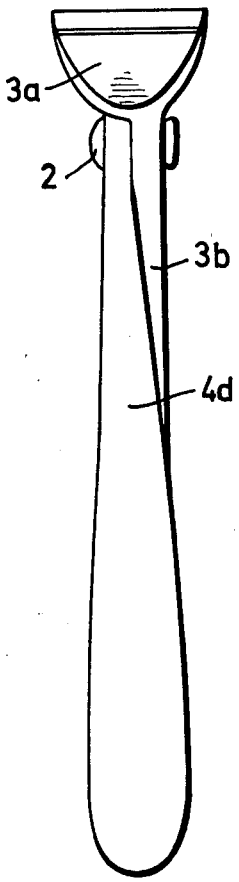
FIG. 7 is a side elevational view of the pincers of FIG. 6.

In a further embodiment, pincers, generally designated 1*a* in FIGS. 6 and 7, differ from pincers 1 of the first embodiment in that, one handgrip portion 4*b* having the wider discharge is arched, as at 16, with the open side of the arch facing toward the flatter handgrip 3*b*. This structure enables a still better gripping of the two handgrip portions 3*b* and 4*b* with a more sure exertion of force.

A further feature of this embodiment, has the handgrip portions 3*b* and 4*d* broadened at the place where the hands of the user grip as shown in FIG. 7. This feature of the invention leads to a smaller surface pressure in the hand.

While the pincers have been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. Pincers comprising:

(a) two pincer legs pivotally mounted on a pivot pin to move in a plane of movement about a common pivotal axis, (b) each leg having a handgrip portion and a head portion, (c) the head portions have respective cutting edges and extend toward each other in open arches and meet with their opposed cutting edges in cutting relationship, (d) said head portions being formed asymmetrically with respect to each other and said cutting edges extend transversely with respect to said plane of movement, (e) a pincer head axis extends along a line connecting the center of the pivot pin with the meeting point of the cutting edges, (f) a longitudinal medial axis is laterally displaced with respect to the pivot pin and extends throughout the length of the pincers between the handgrip portions, and (g) said head axis intersects said medial axis.

2. Pincers as defined in claim 1 wherein
said head portions include upper faces having substantially the same length with respect to each other.

3. Pincers as defined in claim 1 wherein,
when the pincers are in a closed position, the pivot pin is located on one side of the longitudinal medial axis and the cutting edges are located on the other side of the longitudinal medial axis opposite said pivot pin.

4. Pincers as defined in claim 1 wherein
a first one of the handgrip portions has an intermediate rounded portion which receives the pivot pin and is connected to the head portion which extends through the inclined pincer head axis,
said first handgrip portion has an outer face extending from the intermediate rounded portion without a step or shoulder formed therebetween,
the other handgrip portion is connected to the other head portion which has an outer face that is coextensive with the said outer face of the first handgrip portion so that the outer face of the first handgrip portion and the outer face on the head portion of the other handgrip portion are in a straight line.

5. Pincers as defined in claim 4 wherein
the head portion which extends through the inclined pincer head axis also extends at a right angle from said rounded intermediate portion.

6. Pincers as defined in claim 1 wherein,
as seen in plan view, the upper faces of the head portions have thicknesses in the direction of the cutting edges which decrease sharply, and
the shape of the upper faces of the head portions is substantially semielliptical.

7. Pincers as defined in claim 1 wherein
at least one of the handgrip portions is openly arched toward the other handgrip portion.

8. Pincers as defined in claim 1 wherein
at least one of the handgrip portions is widened in the gripping portion for the hand.

* * * * *